US005584281A

United States Patent [19]

Katoh

[11] Patent Number: 5,584,281

[45] Date of Patent: Dec. 17, 1996

[54] ENGINE CONTROL SYSTEM

[75] Inventor: Masahiko Katoh, Hamamatsu, Japan

[73] Assignee: Sanshin Kogyo Kabushiki Kaisha, Hamamatsu, Japan

[21] Appl. No.: 473,254

[22] Filed: Jun. 7, 1995

[30] Foreign Application Priority Data

Jun. 8, 1994 [JP] Japan ..... 6-151523

[51] Int. Cl.[6] ..... F02D 41/14; F02D 17/02

[52] U.S. Cl. ..... 123/681; 123/687; 123/703; 123/481

[58] Field of Search ..... 123/481, 491, 123/679, 703, 681, 687, 198 F; 60/276

[56] References Cited

U.S. PATENT DOCUMENTS

| | | | |
|---|---|---|---|
| 4,768,474 | 9/1988 | Fujimoto et al. | 123/481 |
| 4,831,820 | 5/1989 | Lassankse | 60/276 |
| 4,903,648 | 2/1990 | Lassankse | 123/65 R |
| 4,991,558 | 2/1991 | Daly et al. | 123/481 |
| 5,038,739 | 8/1991 | Ishii | 123/481 |
| 5,040,117 | 8/1991 | Shyu et al. | 123/703 |
| 5,097,811 | 3/1992 | Baumuller | 123/481 |
| 5,283,742 | 2/1994 | Wazaki et al. | 123/481 |
| 5,287,279 | 2/1994 | Anan | 123/481 |
| 5,311,854 | 5/1994 | Cullum | 123/703 |
| 5,404,857 | 4/1995 | Schommers | 123/481 |
| 5,450,830 | 9/1995 | Katoh | 123/481 |

*Primary Examiner*—Willis R. Wolfe
*Attorney, Agent, or Firm*—Knobbe, Martens, Olson & Bear

[57] ABSTRACT

A feedback control system for a multi-cylinder internal combustion engine that employs a combustion condition sensor that senses the condition in only one combustion chamber at the end of the combustion cycle. The power of the engine can be reduced by disabling cylinders other than that from which the combustion products are sensed.

17 Claims, 12 Drawing Sheets

ENGINE CONTROL SYSTEM

BACKGROUND OF THE INVENTION

This invention relates to an engine control system and more particularly to a feedback control system for a multi-cylinder engine.

It has been proposed to employ feedback control systems for engine management. Such control systems sense the condition of the exhaust gases of the engine and adjust the charge forming system so as to maintain the desired fuel/air ratio. Although these systems are quite advantageous, they do not lend themselves to another form of engine management system.

That is, with some engine control systems, it is proposed to disable one or more cylinders of a multi-cylinder engine during some running conditions. The disabled cylinders are permitted to run in an idle like condition and, hence, do not consume any fuel nor require significant power for operation. This gives the effect of having an engine for the powered vehicle that has a variable number of cylinders or the equivalent of variable displacement.

However, where a feedback control system is employed and particularly one which uses an exhaust sensor such as an oxygen sensor, the non-operating cylinders will pump fresh air into the system which will give a false reading of mixture strength. Therefore, when feedback control is employed and one or more cylinders are disabled, then the remaining cylinders may receive an over rich mixture and the benefits of the system are lost or worse.

It is, therefore, a principal object of this invention to provide an improved feedback control system for an engine which also permits certain cylinders to be disabled to improve performance without adversely affecting the feedback control system.

SUMMARY OF THE INVENTION

This invention is adapted to be embodied in both an engine control system and an engine management method for an internal combustion engine having a plurality of combustion chambers. A charge-forming and induction system is provided for supplying a fuel/air charge to the combustion chambers of the engine for their operation. An exhaust system collects the exhaust gases from the combustion chambers and discharges them to the atmosphere. A combustion condition sensor is provided for sensing the combustion products of at least one of the combustion chambers and providing a feedback control for the charge-forming system so as to maintain the desired fuel/air ratio.

In accordance with an engine embodying the invention, means are provided for disabling one or more of the combustion chambers under some engine running conditions. The sensor senses the combustion products from only a combustion chamber that is not disabled so that feedback control can be maintained during the time when one or more of the combustion chambers is disabled without adverse effects.

In accordance with a method for practicing the invention, the combustion products of only one combustion chamber are sensed for providing the feedback control. Under some running conditions, other combustion chambers are disabled so as to reduce the power output of the engine without adversely affecting the feedback control.

DETAILED DESCRIPTION OF THE PREFERRED EMBODIMENTS OF THE INVENTION

Figure 1:
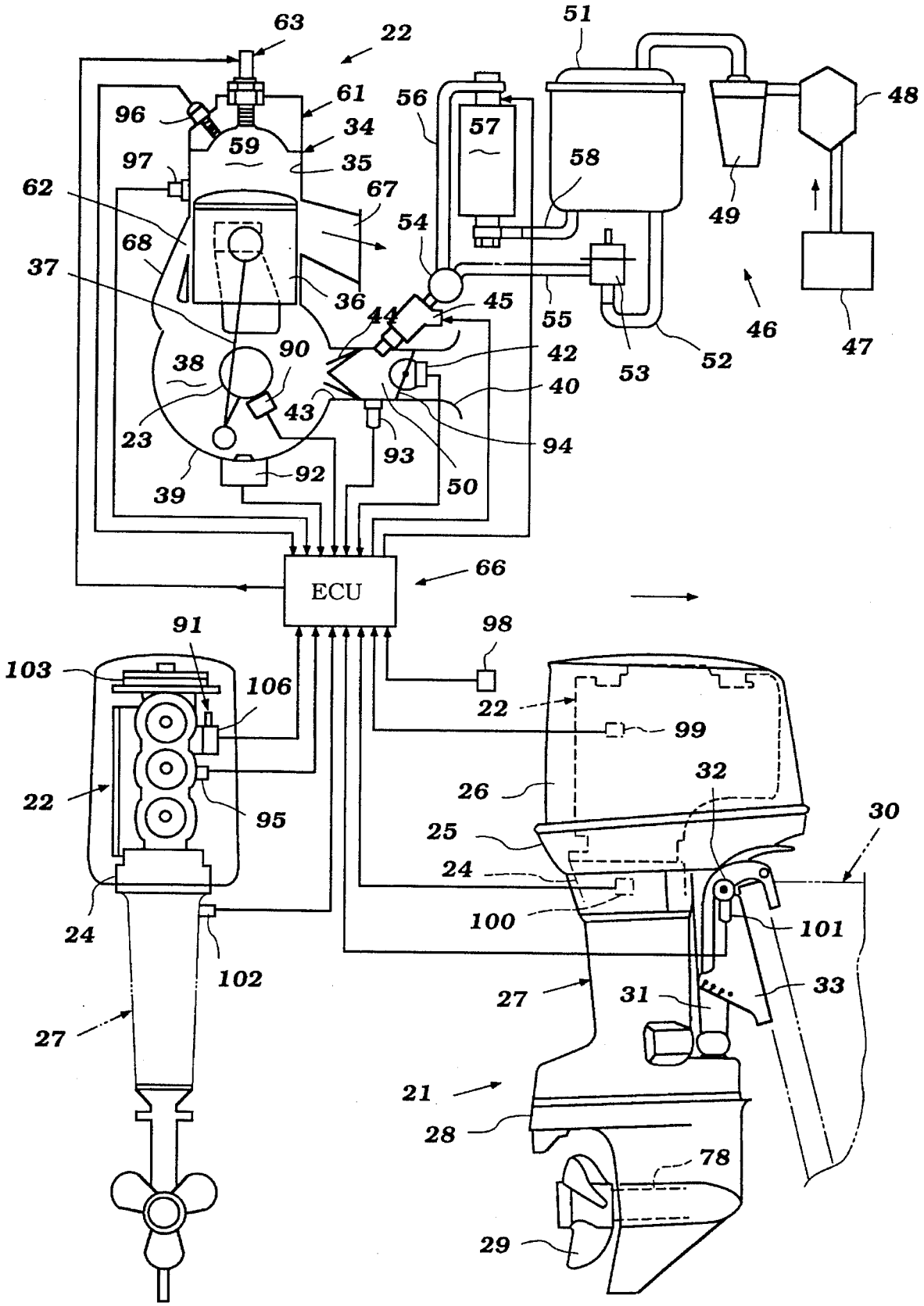
FIG. 1 is a partially schematic view showing an outboard motor constructed and operated in accordance with an embodiment of the invention in side elevation, in rear plan with a portion of the protective cowling removed and in a schematic cross-sectional view, taken through one cylinder of the engine with the fuel supply system and feedback control system being shown in part schematically.
Figure 2:
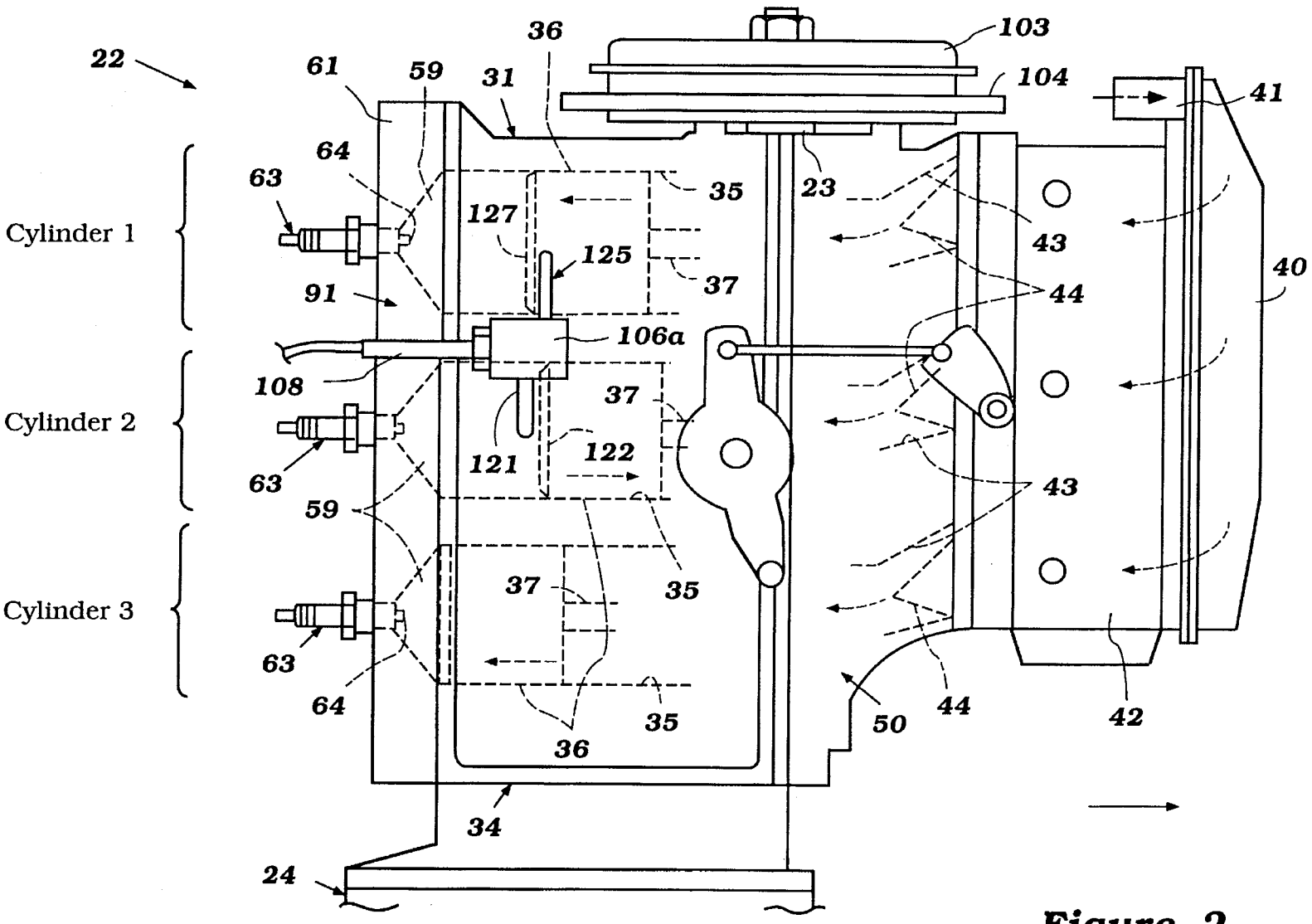
FIG. 2 is an enlarged side elevational view of the engine in the power head and looking in the same direction as the lower right-hand side view of FIG. 1.

Referring now in detail to the drawings, and to the embodiment of FIGS. 1–10 initially by reference to FIG. 1, an outboard motor is shown in the lower portion of this figure in rear and side elevation and is indicated generally by the reference numeral 21. The invention is shown in conjunction with an outboard motor because the invention has particular utility in conjunction with two-cycle crankcase compression engines. Such engines are normally used as the propulsion device for outboard motors. For these reasons, the full details of the outboard motor 21 will not be described and have not been illustrated. Those skilled in the art can readily understand how the invention can be utilized with any known type of outboard motor.

The outboard motor 21 includes a power head that is comprised of a powering internal combustion engine, indicated generally by the reference numeral 22. The engine 22 is shown in the lower left-hand portion of FIG. 3 and in the lower view of FIG. 1, with a portion broken away, and in a schematic cross-sectional view through a single cylinder in the upper view of this figure. The construction of the engine 22 will be described later, but it should be noted that the engine 22 is mounted in the power head so that its crankshaft, indicated by the reference numeral 23, rotates about a vertically extending axis. The engine 22 is mounted on a guide plate 24 provided at the lower end of the power head and the upper end of a drive shaft housing, to be described. Finally, the power head is completed by a protective cowling comprised of a lower tray portion 25 and a detachable upper main cowling portion 26.

The engine crankshaft 23 is coupled to a drive shaft (not shown) that depends into and is rotatably journaled within the aforenoted drive shaft housing which is indicated by the reference numeral 27. This drive shaft then continues on to drive a forward/neutral/reverse transmission, which is not shown but which is contained within a lower unit 28. This transmission provides final drive to a propeller 29 in any known manner for propelling an associated watercraft.

A steering shaft (not shown) is affixed to the drive shaft housing 27. This steering shaft is journaled for steering movement within a swivel bracket 31 for steering of the outboard motor 21 and the associated watercraft shown in phantom and indicated generally by the reference numeral 30 in a well-known manner.

The swivel bracket 31 is, in turn, pivotally connected by a pivot pin 32 to a clamping bracket 33. The clamping bracket 33 is adapted to be detachably affixed to the transom of the associated watercraft 30. The pivotal movement about the pivot pin 32 accommodates trim and tilt-up operation of the outboard motor 21, as is well known in this art.

Continuing to refer to FIG. 1 and now primarily to the lower left-hand side view and the upper view, the engine 22 is depicted as being of the two-cycle crankcase compression type and, in the specific illustrated embodiment, is of a three-cylinder in-line configuration. Although this particular cylinder configuration is illustrated, it will be apparent to those skilled in the art how the invention may be employed with engines having other numbers of cylinders and other cylinder orientations. In fact, certain facets of the invention may also be employed with rotary or other ported type engines with four cycle engines.

The engine 22 includes a cylinder block 34 in which three cylinder bores 35 are formed. Pistons 36 reciprocate in these cylinder bores 35 and are connected by means of connecting rods 37 to the crankshaft 23. The crankshaft 23 is, in turn, journaled for rotation within a crankcase chamber 38 in a suitable manner. The crankcase chamber 38 is formed by the cylinder block 34 and a crankcase member 39 that is affixed to it in any known manner.

As is typical with two-cycle crankcase compression engine practice, the crankcase chambers 38 associated with each of the cylinder bores 35 are sealed relative to each other in an appropriate manner. A fuel-air charge is delivered to each of the crankcase chambers 28 by an induction system which is comprised of an atmospheric air inlet device 40 (see also FIGS. 2 and 3) which draws atmospheric air through an inlet 41 from within the protective cowling. This air is admitted to the protective cowling in any suitable manner.

A throttle body assembly 42 is positioned in an intake manifold 50 downstream of the air inlet 41 and is operated in any known manner. Finally, the intake system discharges into intake ports 43 formed in the crankcase member 39. Reed-type check valves 44 are provided in each intake port 43 for permitting the charge to be admitted to the crankcase chambers 38 when the pistons 36 are moving upwardly in the cylinder bore 35. These reed-type check valves 44 close when the piston 36 moves downwardly to compress the charge in the crankcase chambers 38, as is also well known in this art.

Fuel is added to the air charge inducted into the crankcase chambers 38 by a suitable charge former. In the illustrated embodiments, this charge former includes fuel injectors 45, each mounted in a respective branch of the intake manifold downstream of the respective throttle valve 42. The fuel injectors 45 are preferably of the electronically operated type. That is, they are provided with an electric solenoid that operates an injector valve so as to open and close and deliver high-pressure fuel directed toward the intake port 43.

Fuel is supplied to the fuel injectors 45 under high pressure through a fuel supply system, indicated generally by the reference numeral 46. This fuel supply system 46 includes a fuel tank 47 which is positioned remotely from the outboard motor 21 and preferably within the hull of the watercraft 30 propelled by the outboard motor 21. Fuel is pumped from the fuel tank 47 by means of a fuel pump 48, which may be electrically or otherwise operated. This fuel then passes through a fuel filter 49, which preferably is mounted within the power head of the outboard motor 21. Fuel flows from the fuel filter 49 through a conduit into a fuel vapor separator 51, which includes a float controlled valve for controlling the level of fuel in the fuel vapor separator 51. Any accumulated vapor will condense, and excess vapor pressure can be relieved through a suitable vent (not shown).

Also mounted, preferably in the power head, is a high-pressure fuel pump 53 which is driven in any known manner as by an electric motor or directly from the engine 22. This fuel pump 53 draws fuel from the fuel vapor separator 51 through a conduit 52 and delivers fuel under high pressure to a fuel rail 54 through a conduit 55. The fuel rail 54 serves each of the injectors 45 associated with the engine.

A return conduit 56 extends from the fuel rail 54 to a pressure regulator 57. The pressure regulator 57 controls the maximum pressure in the fuel rail 54 that is supplied to the fuel injectors 45. This is done by dumping excess fuel back to the fuel vapor separator 51 through a return line 58. The regulated pressure may be adjusted electrically along with other controls, as will be described.

The fuel-air charge which is formed by the charge-forming and induction system as thus far described is transferred from the crankcase chambers 38 to combustion chambers, indicated generally by the reference numeral 59, of the engine. These combustion chambers 59 are formed by the heads of the pistons 36, the cylinder bores 35, and a cylinder head assembly 61 that is affixed to the cylinder block 34 in any known manner. The charge so formed is transferred to the combustion chamber 59 from the crankcase chambers 38 through one or more scavenge passages 62.

Spark plugs 63 are mounted in the cylinder head 61 and have their spark gaps 64 extending into the combustion chambers 59. The spark plugs 63 are fired by a capacitor discharge ignition system (not shown). This outputs a signal to a spark coil which may be mounted on each spark plug 63 for firing the spark plug 63 in a known manner.

The capacitor discharge ignition circuit is operated, along with certain other engine controls such as the regulated fuel pressure, by an engine management ECU, shown schematically and identified generally by the reference numeral 66.

When the spark plugs 63 fire, the charge in the combustion chambers 59 will ignite and expand so as to drive the pistons 36 downwardly. The combustion products are then discharged through exhaust ports 67 formed in the cylinder block 34. These exhaust gases then flow through an exhaust manifold, shown in FIG. 4 and identified by the reference numeral 68. The exhaust gases then pass downwardly through an opening in the guide plate 24 to an appropriate exhaust system (to be described later) for discharge of the exhaust gases to the atmosphere. Conventionally, the exhaust gases are discharged through a high-speed under-the-water discharge and a low-speed, above-the-water discharge. The systems may be of any type known in the art.

The engine 22 is water cooled, and for this reason, the cylinder block 34 is formed with a cooling jacket 69 to which water is delivered from the body of water in which the watercraft is operating. Normally, this coolant is drawn in through the lower unit 28 by a water pump positioned at the interface between the lower unit 28 and the drive shaft housing 27 and driven by the drive shaft. This coolant also circulates through a cooling jacket formed in the cylinder head 61. After the water has been circulated through the engine cooling jackets, it is dumped back into the body of water in which the watercraft is operating. This is done in any known manner and may involve the mixing of the coolant with the engine exhaust gases to assist in their silencing. This will also be described later.

Figure 3:
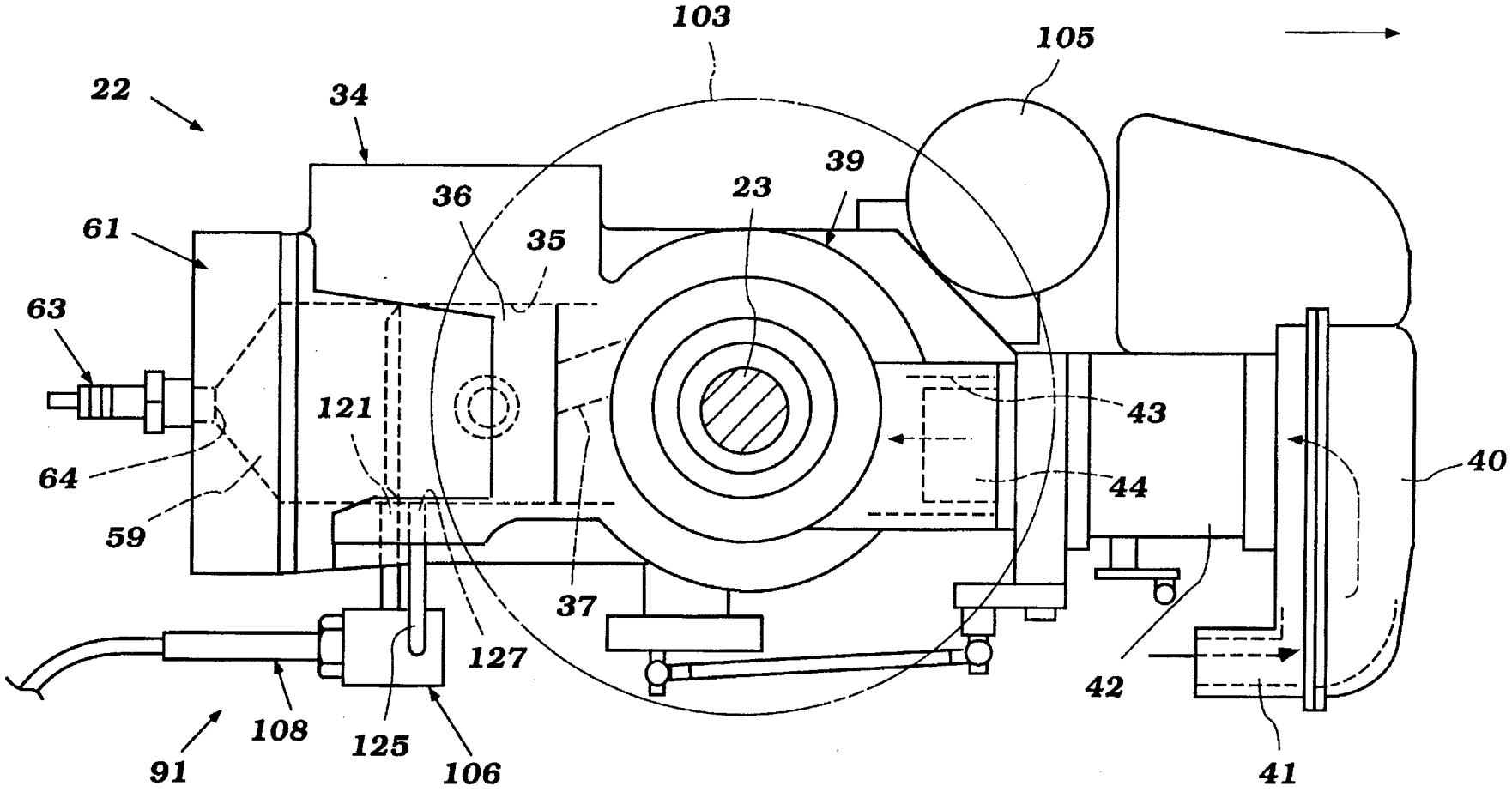
FIG. 3 is a top plan view of the engine as depicted in FIG. 2.

Although not completely shown in the drawings, the engine 22 is also provided with a lubricating system for lubricating the various moving components of the engine 22. This system may spray lubricant into the intake passages in proximity to the fuel injector nozzles 45 and/or may deliver lubricant directly to the sliding surfaces of the engine 22. This lubricant is supplied from a tank 70 mounted adjacent the air inlet device 40 (FIG. 3).

Figure 4:
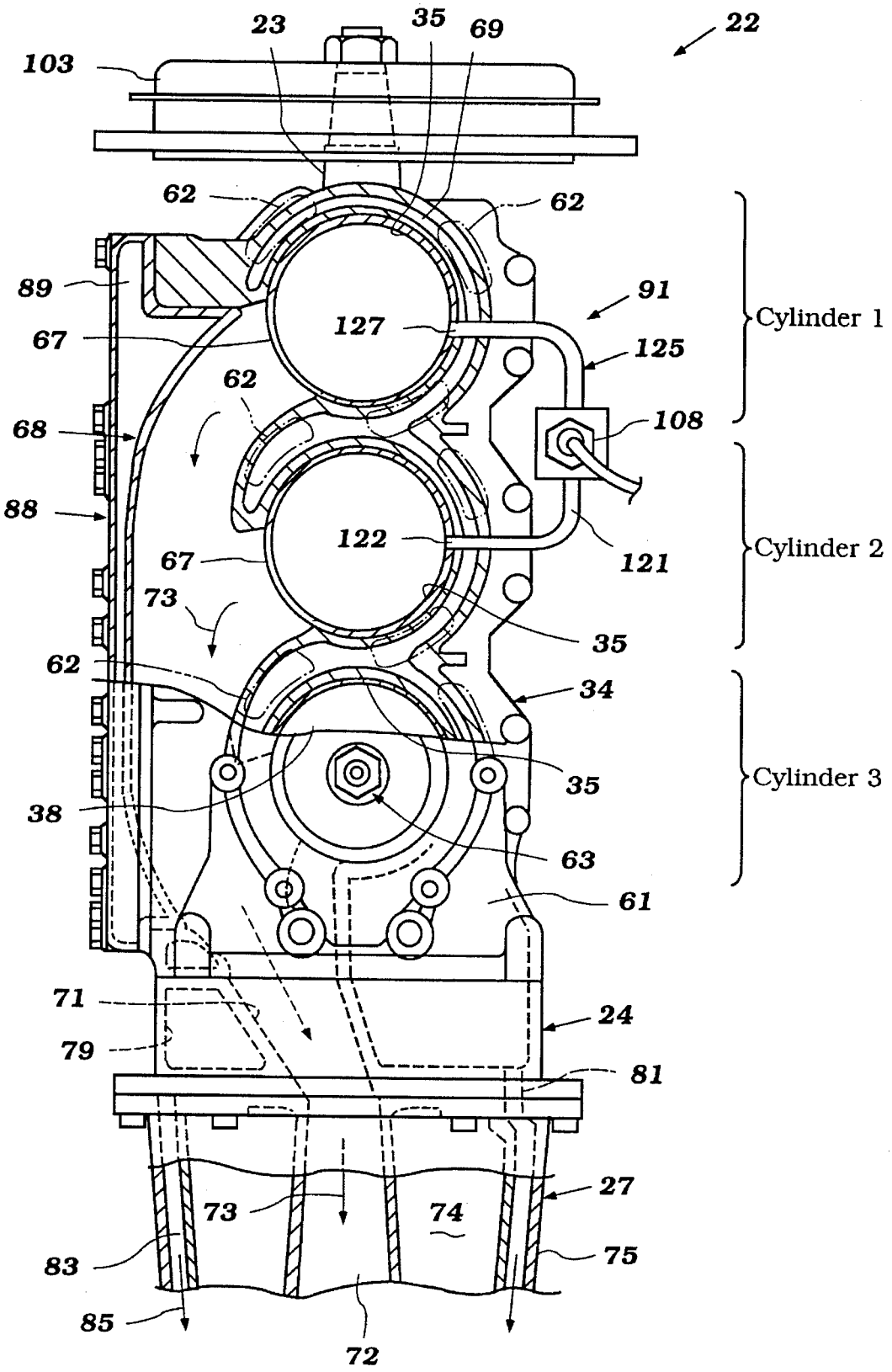
FIG. 4 is a view taken in the same direction as the rear elevational view of FIG. 1 on an enlarged scale and with portions of the engine broken away to more clearly show the construction.
Figure 5:
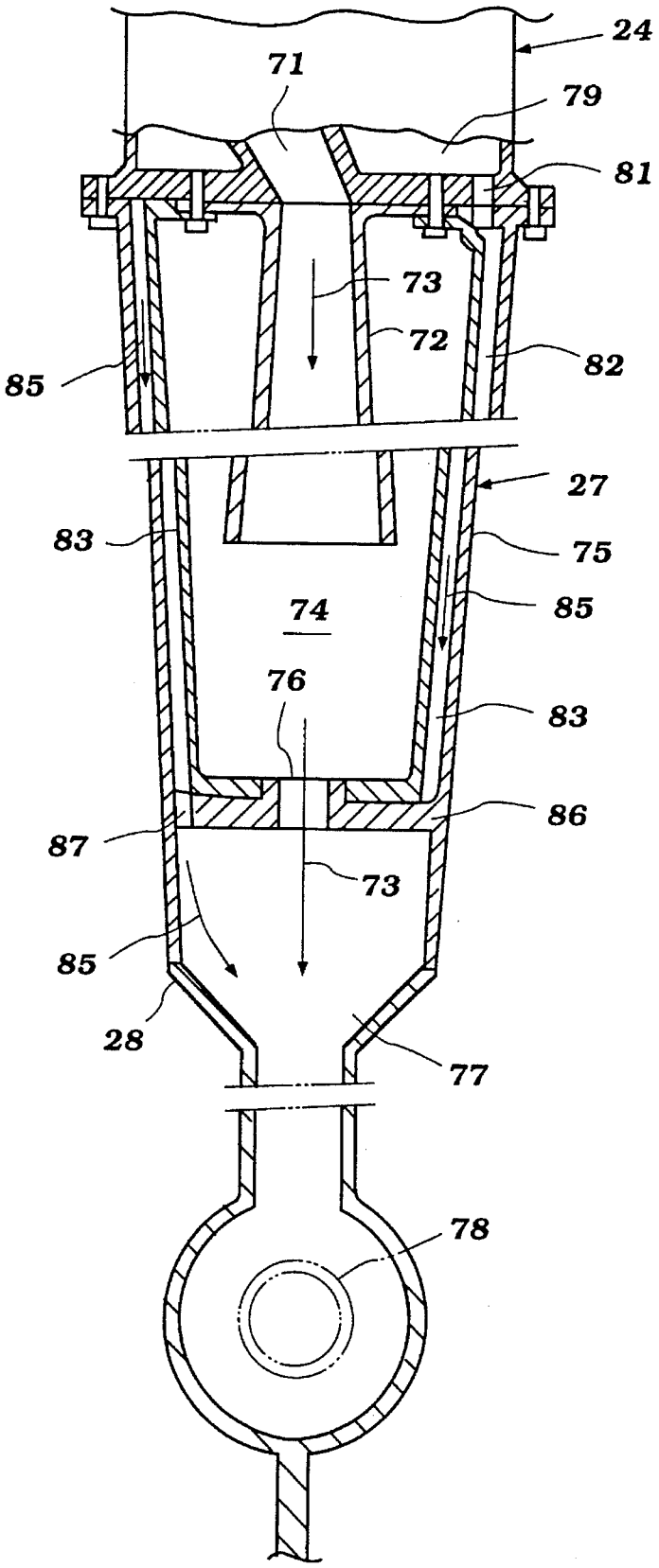
FIG. 5 is a view, in part similar to FIG. 4, and shows the portion of the outboard motor below the power head, and thus forms in part a continuation of FIG. 4 with a further part broken away and shown in section.

Referring now primarily to FIGS. 4 and 5, the exhaust system for discharging the exhaust gases to the atmosphere will be described. As has been noted, the exhaust manifold 68 communicates with an exhaust passage, indicated by the reference numeral 71, that is formed in the spacer or guide plate 24. An exhaust pipe 72 is affixed to the lower end of the guide plate 24 and receives the exhaust gases from the passage 71, as shown by the arrows 73.

The exhaust pipe 72 depends into an expansion chamber 74 formed within the outer shell 75 of the drive shaft housing 27. This expansion chamber 74 is defined by an inner member which has a lower discharge opening 76 that communicates with an exhaust chamber 77 formed in the lower unit 28 and to which the exhaust gases flow.

A through-the-hub, high speed, exhaust gas discharge opening 78 is formed in the hub of the propeller 29 and the exhaust gases exit the outboard motor 22 through this opening below the level of water in which the watercraft 30 is operating when traveling at high speeds. In addition to this high speed exhaust gas discharge, the outboard motor 21 may be provided with a further above-the-water, low speed, exhaust gas discharge (not shown). As is well know in this art, this above-the-water exhaust gas discharge is relatively restricted, but permits the exhaust gases to exit without significant back pressure when the watercraft 30 is traveling at a low rate of speed or is idling, and the through-the-hub exhaust gas discharge 78 will be deeply submerged.

As has been previously noted, the cooling water from the engine cooling jacket 69 may also be mixed with the exhaust gases. To accomplish this, the guide plate 24 is provided with a cooling jacket 79 which extends around the exhaust passage 71 and into which the spent cooling water from the engine 22 is returned. This water is then drained through one or more drain openings 81 formed in the lower surface of the guide plate 24. These openings 81 communicate with a water jacket 82 which is formed in the space 83 existent between the outer shell of the expansion chamber 74 and the inner surface of the drive shaft housing outer shell 75. This water flows in the direction of the arrows 85.

Finally, a horizontally extending wall 86 formed at a lower portion of the drive shaft housing 27 is provided with one or more water discharge openings 87. The water flows through these openings 87, as also indicated by the arrows 85, so as to mix with the exhaust gas flow 73 and be discharged back into the body of water in which the watercraft is operating.

Thus, the existence of the cooling jacket 83 around the expansion chamber 74 provides silencing and cooling. If desired, a cooling jacket may also be formed around the exhaust manifold 68, and this cooling jacket is formed, as shown primarily in FIG. 4, by a cover plate 88 that is affixed to the side of the cylinder block 34 and which defines a cooling jacket 89, as well as a portion of the exhaust manifold 68. Coolant is delivered to this cooling jacket 89 from the engine cooling jacket 69 in an appropriate manner. This water is also then discharged to the guide plate cooling jacket 79.

It has been noted that the ECU 66 controls the capacitor discharge ignition circuit and the firing of the spark plugs 63. In addition, the ECU controls the fuel injectors 45 so as to control both the beginning and duration of fuel injection and the regulated fuel pressure, as already noted. The ECU 66 may operate on any known strategy for the spark control and fuel injection control 45, although this system employs an exhaust sensor assembly indicated generally by the reference numeral 91. In addition, the ECU 66 may disable the firing of one or more of the spark plug 63 for a portion of the engine running time in response to certain conditions, such as low speed low load, so as to provide fuel economy. At the same time, the fuel injector 45 for the cylinder having the disabled spark plug 63 is also disabled so that no fuel will be supplied to the cylinder at that time. The way this system operates will be described later inasmuch as it forms an important part of the invention.

So as to permit engine management, a number of sensors are employed. Some of these sensors are illustrated either schematically or in actual form, and others are not illustrated. It should be apparent to those skilled in the art, however, how the invention can be practiced with a wide variety of control strategies other than or in combination with those which form the invention.

The sensors as shown primarily in FIG. 1 include a crankshaft position sensor 90 which senses the angular position of the crankshaft 23 and also the speed of its rotation. A crankcase pressure sensor 92 is also provided for sensing the pressure in the individual crankcase chambers 38. Among other things, this crankcase pressure signal may be employed as a means for measuring intake air flow and, accordingly, controlling the amount of fuel injected by the injector 45, as well as its timing.

A temperature sensor 93 may be provided in the intake passage downstream of the throttle valve 42 for sensing the temperature of the intake air. In addition, the position of the throttle valve 42 is sensed by a throttle position sensor 94. Engine temperature is sensed by a coolant temperature sensor 95 that is mounted in an appropriate area in the engine cooling jacket 69. An in-cylinder pressure sensor 96 may be mounted in the cylinder head 611 so as to sense the pressure in the combustion chamber 59. A knock sensor 97 may also be mounted in the cylinder block 34 for sensing the existence of a knocking condition.

Certain ambient conditions also may be sensed, such as atmospheric air pressure by a sensor 98, intake cooling water temperature, as sensed by a sensor 99, this temperature being the temperature of the water that is drawn into the cooling system before it has entered the engine cooling jacket 69.

In accordance with some portions of the control strategy, it may also be desirable to be able to sense the condition of the transmission for driving the propeller 29 or at least when it is shifted into or out of neutral. Thus, a transmission condition sensor 100 is mounted in the power head and cooperates with the shift control mechanism for providing the appropriate indication.

Furthermore, a trim angle sensor 101 is provided for sensing the angular position of the swivel bracket 31 relative to the clamping bracket 33.

Finally, the engine exhaust gas back pressure is sensed by a back pressure sensor 102 that is positioned within the expansion chamber 74 which forms part of the exhaust system for the engine and which is positioned in the drive shaft housing 27.

The types of sensors which may be utilized for the feedback control system provided by the ECU 66 are only typical of those which may be utilized in conjunction with the invention. For that reason, further details of the description of the components of the engine and outboard motor that have no particular importance in conjunction with the understanding of the construction and operation of the invention have been deleted.

To be able to understand the construction and operation of the oxygen sensor 91, it is also necessary to identify the various cylinders of the engine since the oxygen sensor 91 is associated with more than one cylinder of the engine 22, for reasons which will become apparent. In order to permit this description to be more clearly understood, the cylinders of the engine 22 have been numbered from top to bottom as cylinder 1, cylinder 2 and cylinder 3. In conjunction with the description of the exhaust sensor 91, therefore, certain of the components which have been employed to describe the actual physical parts of the cylinders may also be identified as associated with a particular cylinder through the use of a suffix indicating the cylinder number to the individual part number.

The cylinders are numbered from top to bottom with cylinder no. 1 being juxtaposed to a flywheel magneto assembly 103 that is affixed to the upper end of the crankshaft 23 in any well known manner. This flywheel magneto assembly 103 supplies electrical power for the aforenoted capacitor discharge ignition system. In addition, it may be provided with a ring gear 104 that cooperates with an electrically operated starter motor 105 (FIG. 3) that is affixed to one side of the cylinder block 34.

Figure 6:
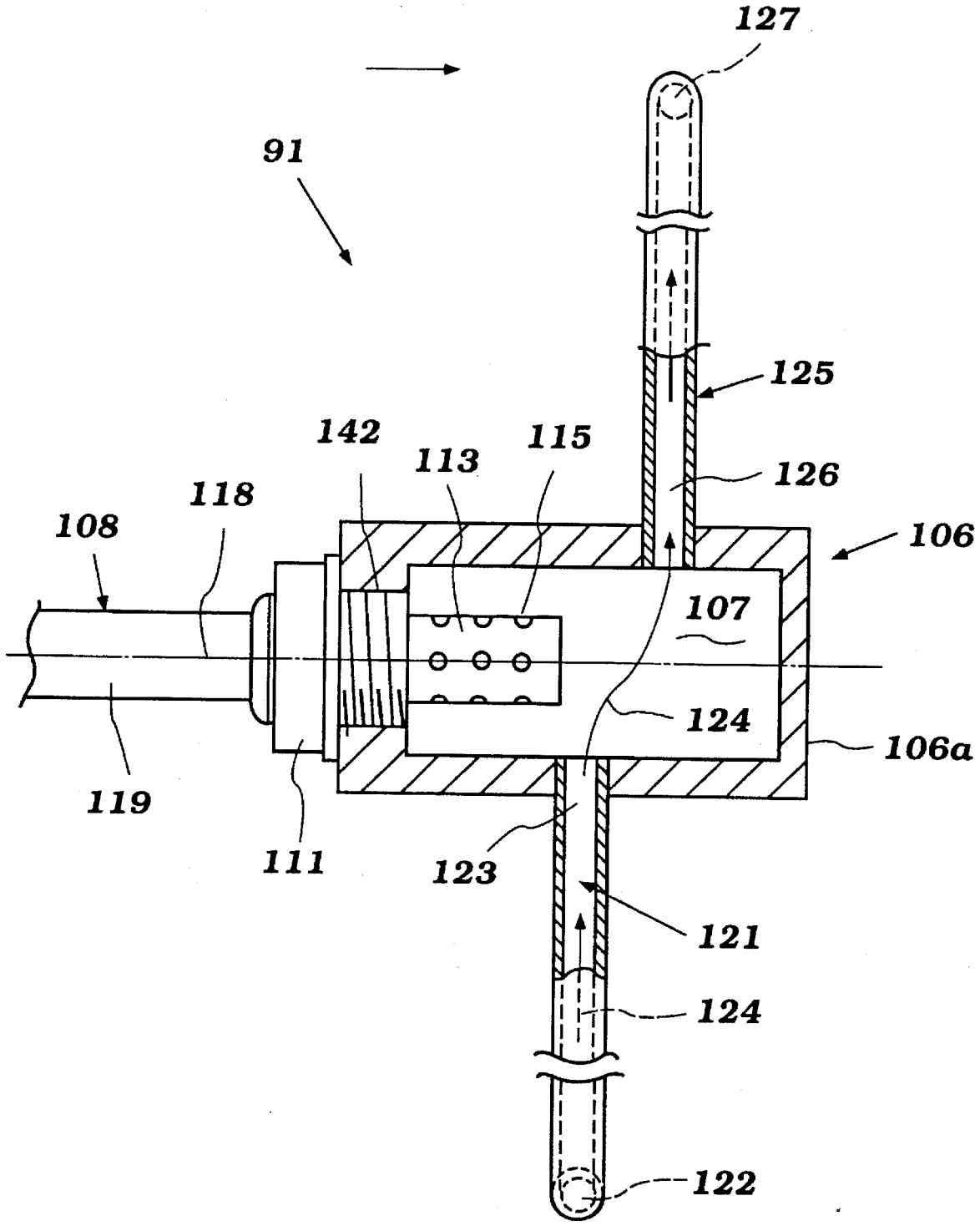
FIG. 6 is an enlarged view looking in the same direction as FIG. 2 with portions broken away and showing the sensor arrangement for the feedback control system.
Figure 7:
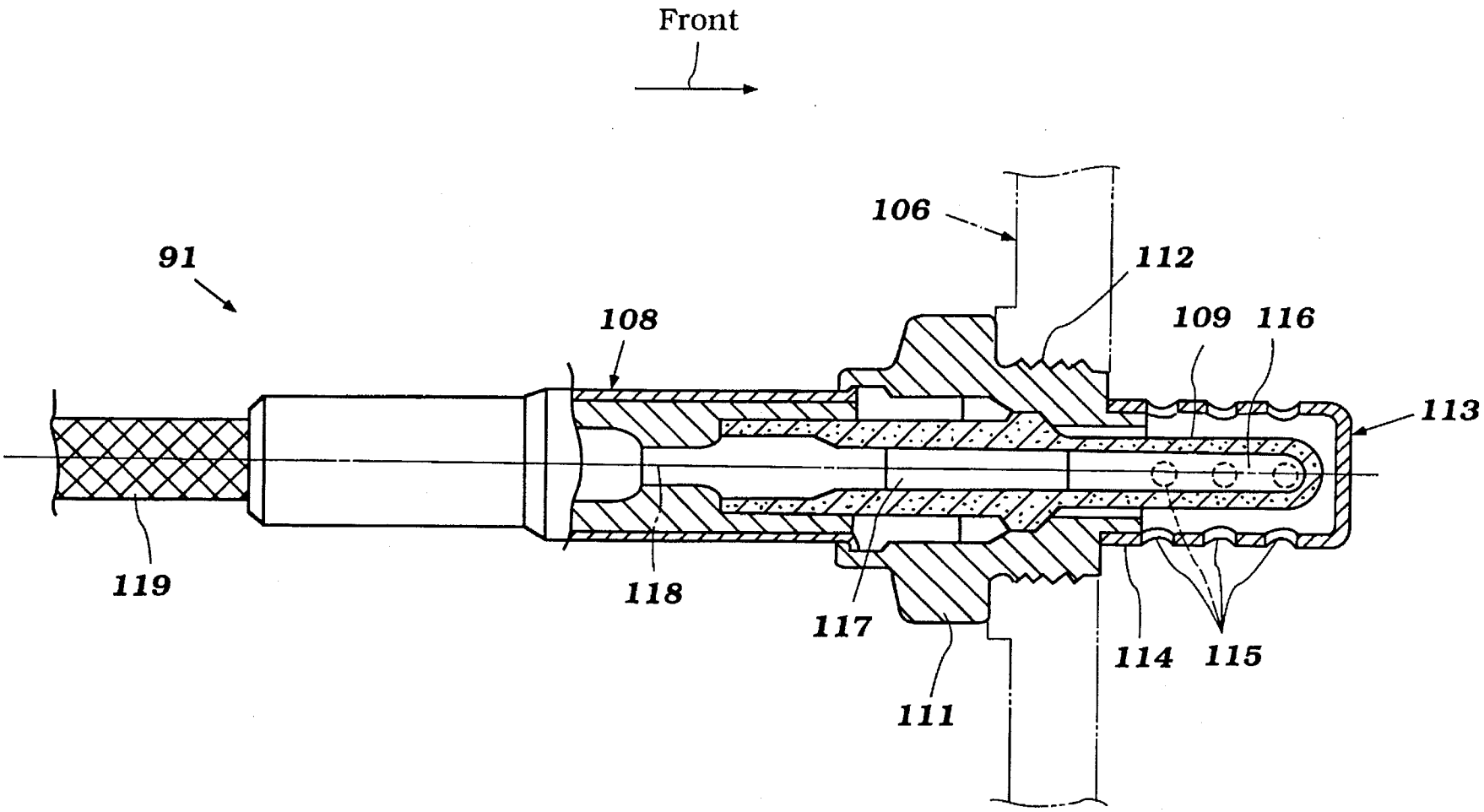
FIG. 7 is a further enlarged cross-sectional view, taken in the same direction as FIG. 6, but shows the sensor element, per se, and its protective arrangement.

The sensor assembly 91 has a construction as best shown in FIGS. 6 and 7, although its interaction with the engine will be described later by reference to other figures. The sensor assembly 91 is comprised of an outer housing assembly, indicated generally by the reference numeral 106, and which is comprised, in this embodiment, of an outer housing piece **106*a* that defines a relatively large accumulator volume 107**.

A sensor element, in this case an oxygen sensor, indicated generally by the reference numeral 108, has its sensing portion 109 mounted within a fitting 111 which, in turn, has a threaded connection 112 with the outer housing element **106*a*, so that the sensor portion 109 extends into the accumulator chamber 107. However, the sensor portion 109 is protected by means of a protecting shell 113 that is fitted onto a tubular projection 114 of the mounting fitting 111. A plurality of openings 115 are formed in the shell 113 so as to permit the communication of exhaust gases with the sensor portion 109, but also to protect the sensor portion 109** from damage.

The sensor portion 109 is formed as a platinum-plated glass tube having a hollow center 116. An electrical heater 117 extends in the hollow center 116 along the centerline 118 of the sensor 108 and which communicates with the ECU 66 through a shielded conductor 119. As is known, the element 109 will output a signal indicative of oxygen content in the exhaust gas, and thus provides an indicator whether the fuel/air mixture is stoichiometric or not. The actual constituency of the sensor 109 may be of any desired type utilized in this control art. The sensor 109 is positioned in the accumulator chamber 107 in such a manner and is of such a size that it occupies substantially less than one-half of the volume of the accumulator chamber 107. This ensures that the gas actually sensed by the sensor element 109 will be representative of the actual combustion products of one cylinder of the engine.

The exhaust gases or combustion products are delivered to the accumulator chamber 107 in a timed relationship from only one cylinder of the engine. In this particular embodiment, the cylinder which supplies the exhaust gases to the accumulator chamber 107 is cylinder no. 2. The way in which this is accomplished will now be described by primary reference to FIGS. 6–10, although the structure also appears in certain of the other figures.

Figure 9:
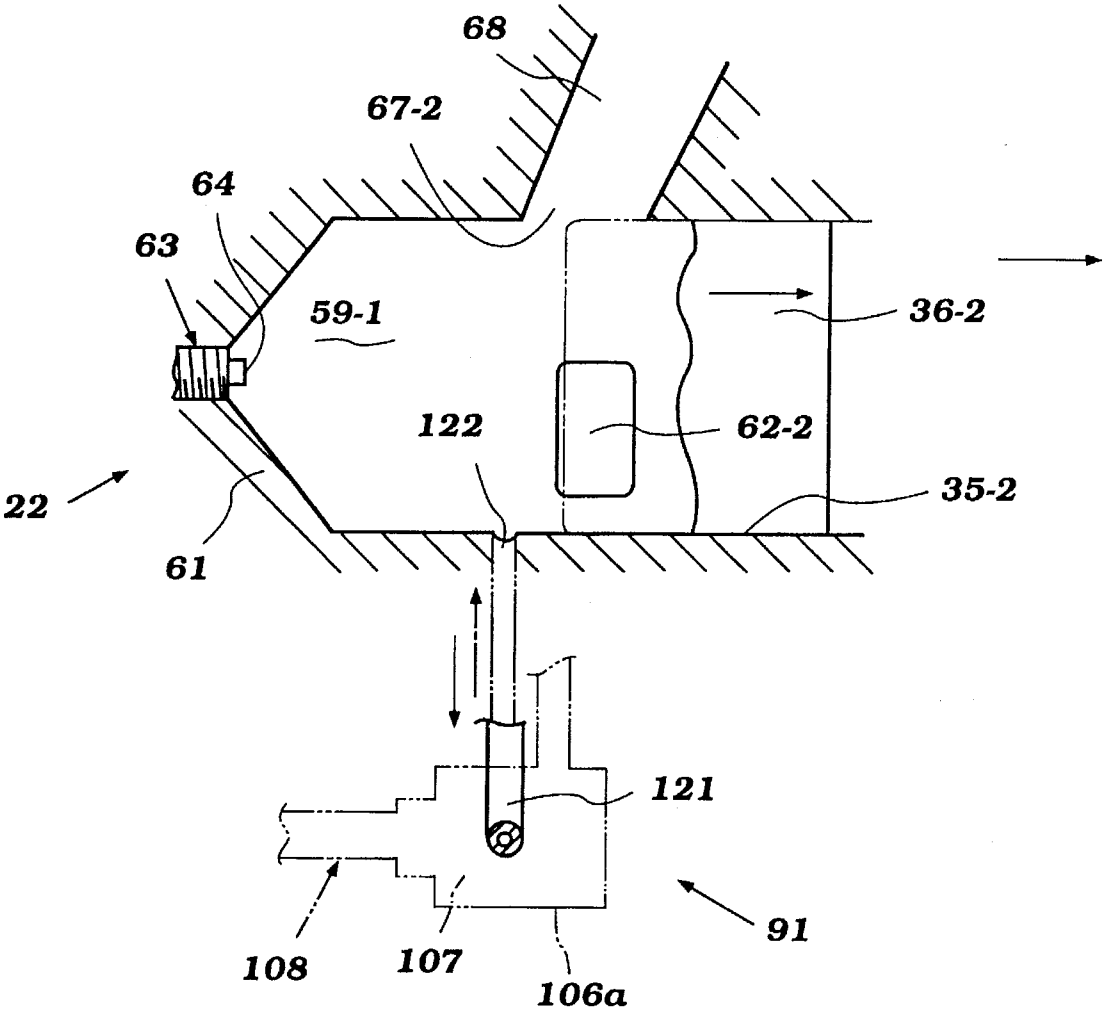
FIG. 9 is a view, in part similar to FIG. 8, and shows the connection of the sensor to the other cylinder.

A first or inlet conduit 121 opens into the accumulator chamber 107 and has an inlet port 122 which opens into the cylinder bore 35-2 of the no. 2 cylinder. This inlet port 122 is disposed at a point approximately equal to the point where the exhaust port 67-2 is opened as the piston 36-2 is moving down at the end of the expansion and the beginning of the scavenge stroke, as shown in FIG. 9. The direction of piston travel is indicated by the arrow 123. Thus, under the condition as shown in FIG. 9, exhaust or combustion gases will flow from the combustion chamber 59-2 into the accumulator chamber 107 through a port 122 formed at the end of the conduit 121, and as shown by the arrow 124. It should be noted that this communication is open at the time when the piston 36-2 first slides past the communication port 122, and this occurs substantially at the end of the combustion and expansion phase and before the scavenge ports 62-2 of this cylinder (2) are opened.

Figure 8:
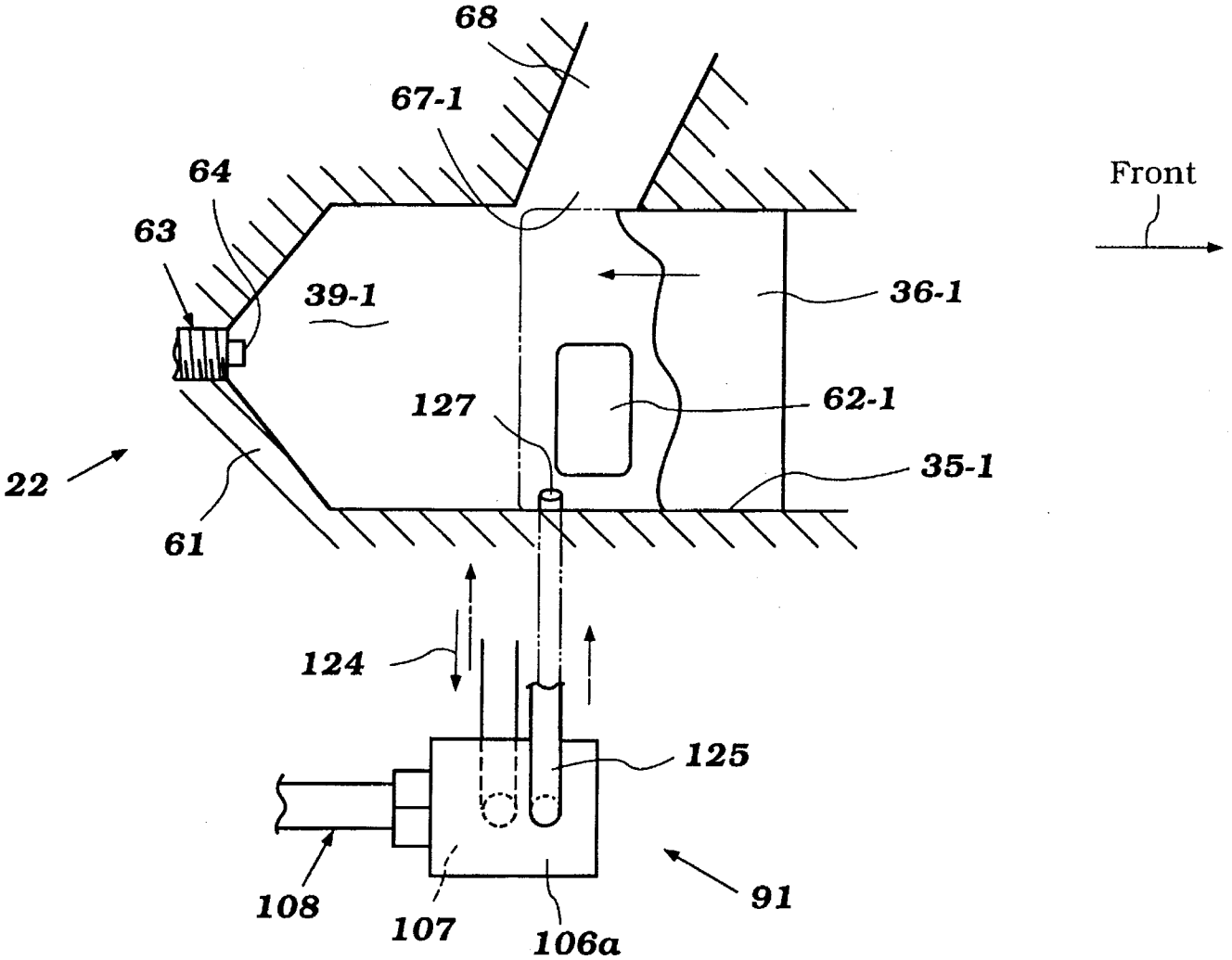
FIG. 8 is a partially schematic view and shows the relation of the sensor to one of the two cylinders with which it is connected.

A further exhaust conduit 125 extends from a point in the accumulator chamber 107 that is, in this embodiment, spaced further from the sensor element 109 than the port 122 from cylinder no. 2. This communication passageway 125 has an inlet port 126 which opens into the accumulator chamber 107 and a discharge port 127 which communicates with cylinder no. 1, as shown in FIG. 8.

It should be noted that the communication port 127 intersects the cylinder bore 35-1 at a point adjacent where its scavenge port 62-1 will be opened when the piston 36-1 moves downwardly. That is, the ports 122 and 127 of the communication conduits 121 and 125 have a different timing relative to the events in the cylinders with which they are associated. Also, it should be noted that the cylinders are out of phase with each other, as is typical with engine practice, so as to provide more uniform firing impulses. This condition may be best seen in FIG. 10, wherein the timing phase for each cylinder is depicted in relation to crankshaft rotation.

It will be seen that the cylinders 1, 2 and 3 reach top dead center position at 120° from each other so as to provide equal firing impulses. It will be also seen from FIG. 10 that because of the spacing of the respective port openings 122 and 127, the port opening 122 will be opened and closed for approximately equal crank angles. However, the port 127 will be opened a shorter time than that of the port 122, and closed for a longer time than it is open. Also, the opening and closing times are staggered from each other, as shown in this figure, due to the difference in timing of the individual cylinders.

Figure 10:
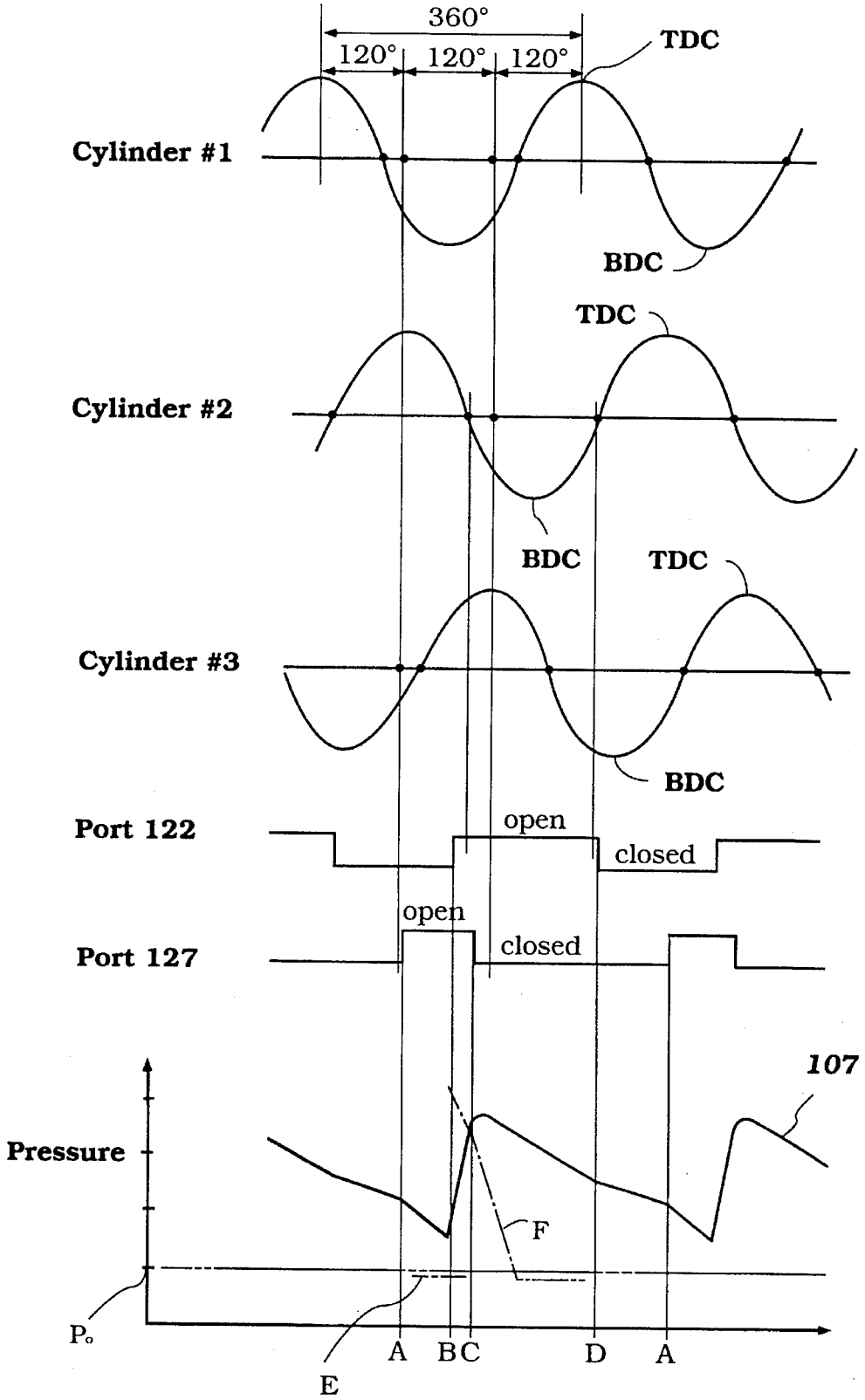
FIG. 10 is a graphical view showing the cycle of operation of each of the three cylinders of the engine of this embodiment in relation to crank angle, the condition of the porting communications to the sensor in the sensed cylinder and the controlling cylinder, and the pressure existent in the accumulator chamber where the sensor element is positioned, and the sensor timing interval.

Thus, beginning at the crankshaft rotation indicated by the point A in FIG. 10, cylinder no. 2 will be at a point slightly after its top dead center position, with the piston 36-2 moving downwardly in the cylinder bore, as shown by the arrow in FIG. 9. However, the piston 36-2 will be displaced in the cylinder bore 35-2 well above the position shown in FIG. 9 so that the port 22 will be closed and the combustion will have just begun and the gases will be expanding. At this same time, the piston 36-1 in cylinder no. 1 will still be traveling downwardly in a direction opposition to the arrows shown in FIG. 8 and the piston will be approximately in the position shown in FIG. 8, with the port 127 just about to open. At this time, the pressure of the gases trapped in the chamber 107 will have fallen to a point, as shown in this figure from internal leakage.

Upon continued rotation of the crankshaft 23, the port 127 will open, while the port 122 is still closed, and the pressure in the accumulator chamber 107 will fall and the gases will flow from the chamber 107 to the cylinder bore 35-1. At this point in time, the pressure in the cylinder bore 35-1, and specifically in its combustion chamber 39-1, will be substantially lowered because the exhaust port will have been open for some time and the scavenge port will have just opened along with the opening of the port 127. This is shown by the line E in FIG. 10. Thus, the pressure in the accumulator chamber 107 will be higher than this pressure and flow will occur in the, direction of the arrows, as indicated in FIG. 8. FIG. 10 also shows the drop-off of pressure in the accumulator chamber.

This movement continues with the piston 36-1 of cylinder 1 reaching its bottom dead center position and then moving upwardly, as shown by the arrow in FIG. 8, in a direction to close the scavenge port 62-1 and eventually the port 127 communicating with the accumulator chamber 10.7. However, before the port 127 iS closed, the piston in 36-2 in cylinder no. 2 will have moved past the port 122 and it will be opened at approximately the same time the exhaust port 67-2 of this cylinder opens. As a result, the high pressure gases from the combustion chamber 59-2, which have not had a chance to dissipate through full opening of its exhaust port 67-2, will flow through the conduit 121, as shown by the arrow 124, into the accumulator chamber 107. When the port 127 opens, the pressure at this port and in the cylinder bore No. 2 will fall rapidly as shown by the curved F in FIG. 10. However, because of the fact that the accumulator chamber 107 has a relatively large volume in relation to the sensor and also since the ports 122 and 127 are somewhat restricted, the actual pressure in the chamber 107 will not fall as rapidly as the actual pressure drops at the port 122. Also, the closing of the port 127 will trap the chamber 107 and this will prevent the pressure from falling off as rapidly as it does in the actual cylinder bore at the port 122.

When the port 122 does close at the point B, then the pressure in the accumulator chamber 107 will build up quite rapidly, and the accumulator chamber 107, which has been purged by the flow when both ports were open, will be charged with the fresh combustion products from combustion chamber 59-2. This build-up pressure occurs until and slightly after the point C when the port 127 closes. This operation continues, although the pressure in the accumulator chamber 107 will then begin to fall, due to the exhaust of gases as its exhaust port 67-2 is opened, until this port again closes at the crank angle D.

Hence, the time period C to D is a time period when the exhaust gases in the chamber 107 will represent the instantaneous condition in cylinder no. 2 and the ECU 66 is programmed so as to read the output from the sensor element 109 during this time period. Thus, a very good reading of exhaust gas constituents combustion process can be measured at this time, and then appropriate feedback control initiated by the ECU 66 to provide the appropriate air/fuel ratio and exhaust emission control. As can be seen from the foregoing description, the sensor 109 actually senses the combustion products from only one cylinder of the engine. From this data, it is possible to provide feedback control for all cylinders since the relationship of the cylinders one to the other can be established.

In addition to this, the system permits the disabling of one or more cylinders for each revolution of the crankshaft or for alternate revolutions in order to reduce the power of the engine and thus, in effect, change the engine's effective displacement. This can be done without the air that is pumped from the disabled cylinder effecting the output of the sensor 109.

Figure 11:
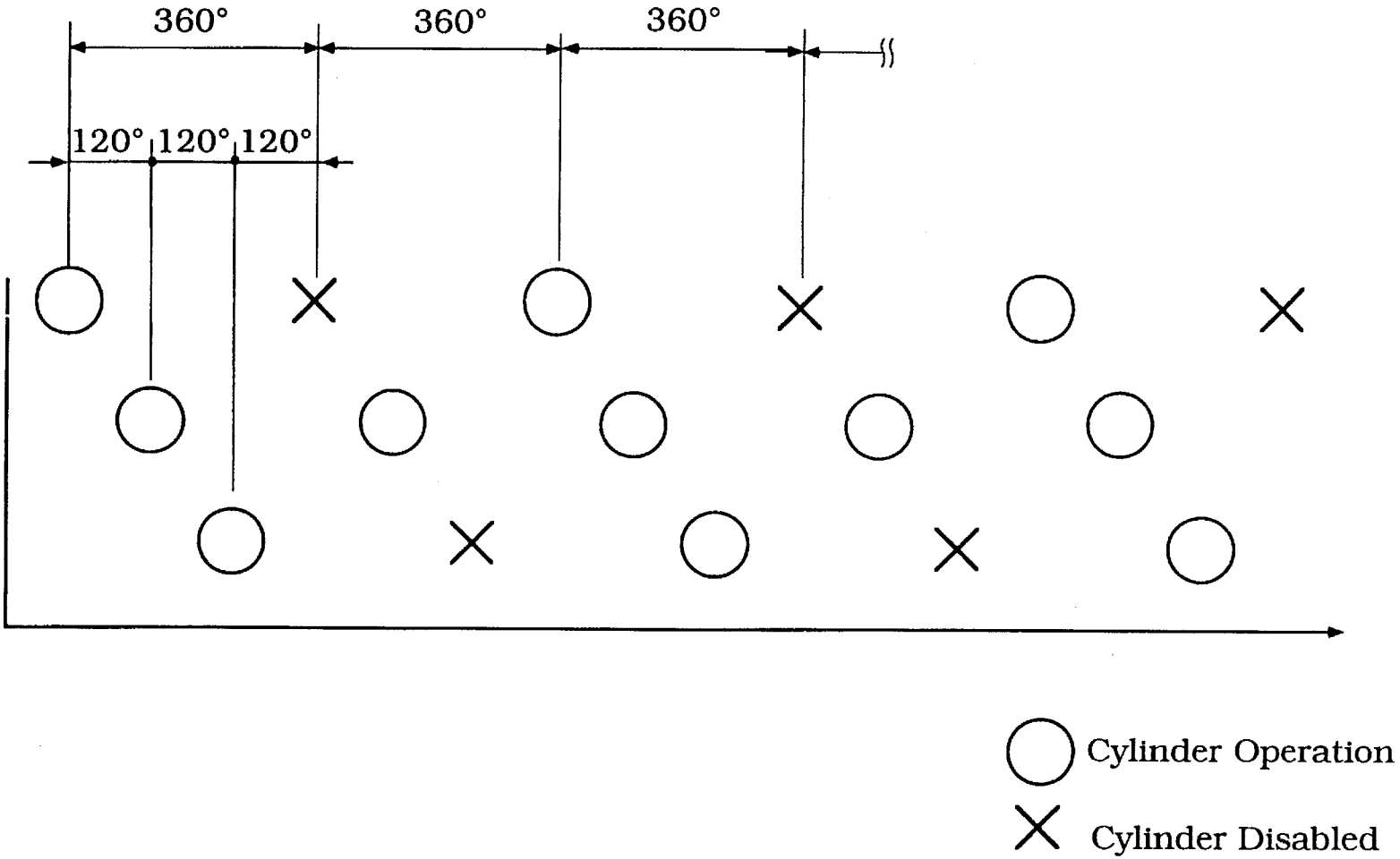
FIG. 11 is a graphical view showing the cylinder firing or non-firing of the cylinders of the engine during a power reduction phase of operation.

FIG. 11 shows one way in which this reduction in power and reduction of effective displacement can be obtained. In this embodiment, cylinders numbers 1 and 3 (not sensed cylinders) are disabled of every other revolution by discontinuing the spark signal from the ECU 66 to their respective spark plugs 63 and, at the same time, discontinuing the actuation of the fuel injectors 45 associated therewith. Even though cylinder number 1 is disabled, its communication with the accumulator chamber 107 is maintained and is not adversely effected because of the fact that the combustion products or the air in this cylinder never reaches the accumulator chamber 107. Thus, very effective power control or effective displacement control can be obtained while the feedback control will still be accurate.

Figure 12:
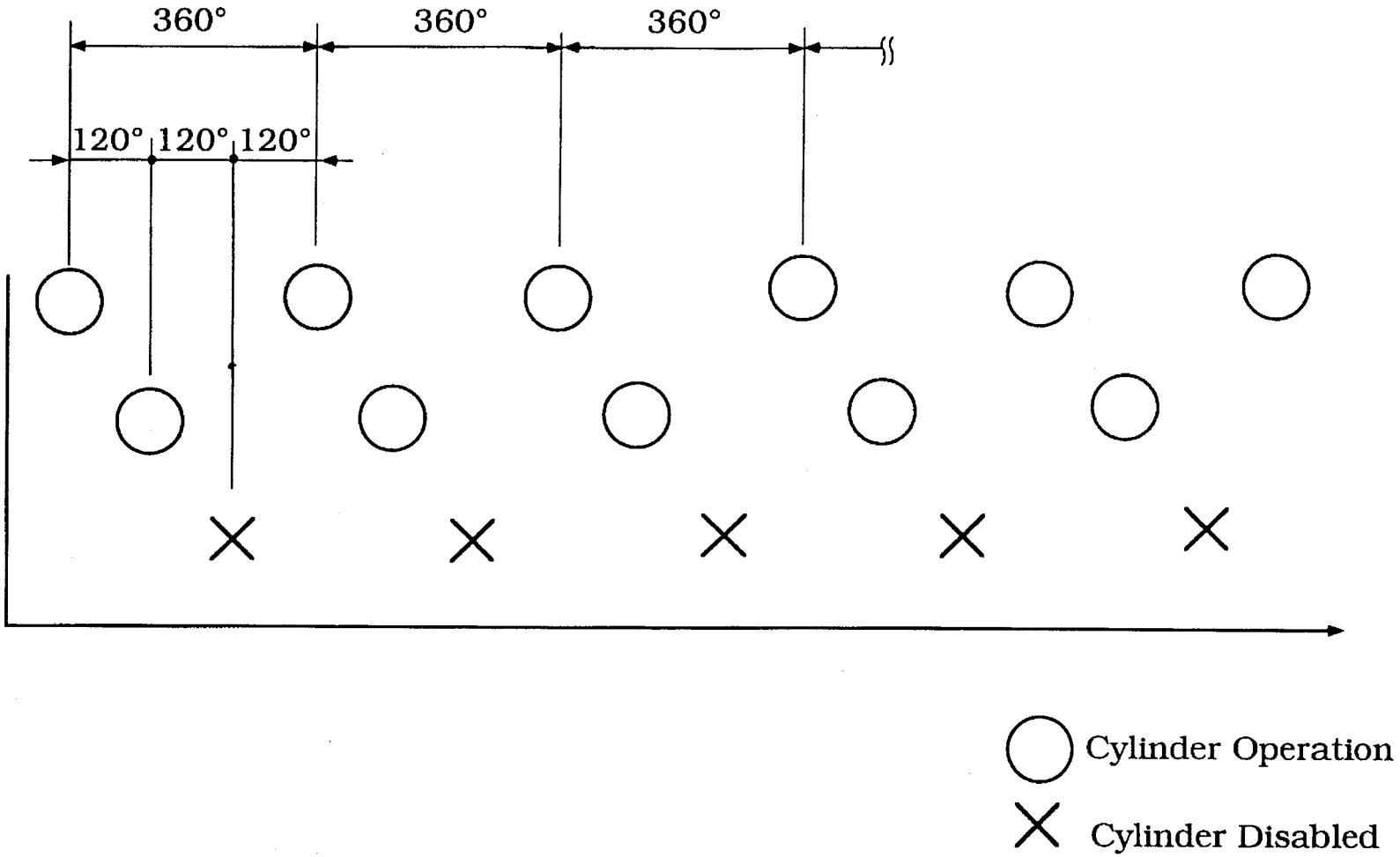
FIG. 12 is a diagram in part similar to FIG. 11, and shows another embodiment of power reduction.

FIG. 12 is a graphical view, in part similar to FIG. 11, and shows another way in which the engine power and effective displacement can be decreased. In this embodiment, only cylinder number 3 is disabled and this is done for each cycle of operation. Again, the feedback control is not adversely affected because the firing of cylinder number 2, the one that supplies the signal to the sensor 109, is fired normally. Again, the condition in the accumulator chamber 107 is not affected by the non-firing cylinders.

The number of cylinders disabled and the timing of disabling can obviously be varied so as to change the effective power and displacement. This can be done so long as the firing of cylinder number 2 is maintained uniform without adversely affecting feedback control. It is also possible to maintain feedback control even if cylinder number 2 or the sampled cylinder is fired intermittently. Of course, if this is done then reading should only be taken when that cylinder is fired and its operation should be discontinued less frequently than the other cylinders. In addition to applying this principle to a two-cycle engine, it should be readily apparent that the same principle can be applied to four-cycle engines, although the invention has particular utility with two-cycle engines. Various other changes and modifications may be made without departing from the spirit and scope of the invention, as defined by the appended claims.

I claim:

1. An internal combustion engine and control comprising a plurality of combustion chambers, an induction and charge-forming system for supplying fuel to said combustion chambers, means for igniting a charge in each of said combustion chambers for initiating combustion therein, exhaust means for discharging exhaust gases from each of said combustion chambers, a combustion condition sensor for sensing combustion condition in only one of said combustion chambers and providing an output signal indicative of the combustion condition, feedback control means for controlling the said charge-forming device for varying the fuel/air ratio supplied to said combustion chambers in response to the output signal from said combustion condition sensor, means for sensing an engine condition, and means for disabling the operation of at least one other of said combustion chambers under low load, low speed conditions for decreasing the effective displacement and power of said engine.

2. An internal combustion engine and control as in claim 1, wherein the means for disabling the operation of the at least one of the other of said combustion chambers disables the means for initiating combustion therein.

3. An internal combustion engine and control as in claim 1, wherein the means for disabling the operation of the at least one of the other of said combustion chambers disables the means for supplying fuel thereto.

4. An internal combustion engine and control as in claim 3, wherein the means for disabling the operation of the at least one of the other of said combustion chambers also disables the means for initiating combustion therein.

5. An internal combustion engine as set forth in claim 1, wherein the combustion condition sensor senses the combustion products directly from the one combustion chamber.

6. An internal combustion engine as set forth in claim 5, wherein the engine operates on a two-stroke crankcase compression principle and the combustion products are sensed by communicating the combustion condition sensor with the one combustion chamber through a port juxtaposed to open at approximately the same time as the engine exhaust port opens.

7. A feedback control system for an internal combustion engine as set forth in claim 6, wherein the combustion product sensor is positioned in a conduit interconnecting the port with a port in another combustion chamber operating on a different cycle for maintaining a constant flow of combustion products to the combustion condition sensor on each cycle of operation of the first-mentioned combustion chamber.

8. An internal combustion engine and control as in claim 7, wherein the means for disabling the at least one of the other of said combustion chambers disables the means for initiating combustion therein and the means for supplying fuel thereto.

9. An internal combustion engine and control as in claim 8, wherein the firing of the one combustion chamber is not disabled and the feedback control for all nondisabled combustion chambers is controlled by the output from the combustion condition sensor.

10. A method of operating an internal combustion engine comprising a plurality of combustion chambers, an induction and charge-forming system for supplying fuel to said combustion chambers, means for igniting a charge in each of said combustion chambers for initiating combustion therein, exhaust means for discharging exhaust gases from each of said combustion chambers, said method comprising the steps of sensing the combustion condition in only one of said combustion chambers, controlling the charge-forming device for varying the fuel/air ratio supplied to said combustion chambers in response to the sensed combustion condition, sensing an engine condition, and disabling the operation of at least one other of said combustion chambers under low load, low speed conditions for decreasing the effective displacement and power of said engine.

11. A method as in claim 10, wherein the at least one of the other combustion chambers is disabled by disabling the means for initiating combustion therein.

12. A method as in claim 10, wherein the at least one of the other combustion chambers is disabled by discontinuing the supply of fuel thereto.

13. A method as in claim 12, wherein the ignition of the at least one of the other combustion chambers is also disabled.

14. A method as set forth in claim 10, wherein the engine operates on a two-stroke crankcase compression principle and the combustion products are sensed by communicating with the one combustion chamber through a port juxtaposed to open at approximately the same time as the engine exhaust port opens.

15. A method as set forth in claim 14, wherein a combustion condition sensor is positioned in a conduit interconnecting the aforenoted port with a port in another combustion chamber operating on a different cycle for maintaining a constant flow of fresh combustion products to the combustion condition sensor on each cycle of operation of the first-mentioned combustion chamber.

16. A method as in claim 15, wherein the combustion chamber is disabled by disabling the means for initiating combustion therein and the means for supplying fuel thereto.

17. A method as in claim 16, wherein the firing of the one combustion chamber is not disabled and the feedback control for all non-disabled combustion chambers is controlled by the output from the combustion condition sensor.

* * * * *